US005106435A

United States Patent [19]

Hudson

[11] Patent Number: 5,106,435

[45] Date of Patent: Apr. 21, 1992

[54] METHOD FOR MINIMIZING SURFACE CARBIDE FORMATION DURING BOX ANNEALING

[75] Inventor: Robert M. Hudson, Pittsburgh, Pa.

[73] Assignee: USS, Pittsburgh, Pa.

[21] Appl. No.: 554,996

[22] Filed: Jul. 20, 1990

[51] Int. Cl.[5] ..... C23C 8/00

[52] U.S. Cl. ..... 148/253; 148/256

[58] Field of Search ..... 148/253, 100, 110, 113, 148/254, 256, 243

[56] References Cited

U.S. PATENT DOCUMENTS

| | | | |
|---|---|---|---|
| 2,501,846 | 3/1950 | Gifford | 148/245 |
| 2,748,037 | 5/1956 | Burnham | 148/253 |
| 3,104,993 | 9/1963 | Slevert et al. | 148/253 |
| 3,308,042 | 3/1967 | Lozano et al. | 148/253 |
| 3,382,110 | 5/1968 | Lozano et al. | 148/253 |

OTHER PUBLICATIONS

W. H. McFarland, "Surface Carbides in Batch Annealed Cold Rolled Steel", 1988 Mechanical Working and Steel Processing Proceedings, pp. 155 through 162, Oct. 23-26, 1988.

*Primary Examiner*—Jay H. Woo
*Assistant Examiner*—Jeremiah F. Durkin, II
*Attorney, Agent, or Firm*—Sughrue, Mion, Zinn, Macpeak & Seas

[57] ABSTRACT

A method for minimizing surface carbide formation during box annealing of DQSK steels includes as a first step treating the surface of an aluminum-killed steel suitable for production of DQSK product with an aqueous solution containing about 0.1 to 1.0 moles of phosphate ion per liter. This treatment is applied to provide a surface phosphorus concentration on the steel of at least about 10 mg P/ft$^2$. The treated steel is then box annealed at a temperature of at least about 1250° F. in a hydrogen-rich atmosphere which is non-oxidizing to steel.

8 Claims, No Drawings

METHOD FOR MINIMIZING SURFACE CARBIDE FORMATION DURING BOX ANNEALING

BACKGROUND OF THE INVENTION

1. Field Of The Invention

This invention pertains to a method for minimizing the formation of surface carbides on steels during annealing. More particularly, it pertains to a method for minimizing surface carbide formation during box annealing of drawing quality specially-killed steels.

2. Description Of Related Art

Aluminum-killed steels, both continuous cast and ingot cast, are often used in applications requiring superior drawing characteristics, such as sheets and coated sheet products. To impart the desired texture and drawing characteristics to these steels, coils are box annealed at temperatures above 1250° F. The product of the annealing process is a drawing quality, specially-killed (DQSK) steel.

While the box annealing process imparts the desired formability characteristics, it is not without drawbacks. In commercial charges, coil temperatures often exceed the ferrite to austentite transition temperature ($A_1$ temperature), approximately 1340° F. to 1350° F. for low carbon steels. At temperatures above the $A_1$ temperature, aluminum-killed steels are susceptible to the formation of surface carbides. These carbides, which consist mainly of cementite ($Fe_3C$.). are undesirable. W.H. McFarland has characterized their formation during batch annealing as "[o]ne of the more mystifying phenomena in the production of cold rolled steel sheets." W. H. McFarland, *Surface Carbides In Batch Annealed Cold Rolled Steel,* 1988 Mechanical Working and Steel Processing Proceedings 155. He attributes their formation to the migration of carbon from within the sheet during batch annealing of tight coils, and states that > surface carbides are extremely tenacious and can cause problems in hot dip and electrogalvanizing coating processes as well as interfering with phosphating and electrotinning processes.

Consistent with McFarland's observations, it has been found that untreated DQSK steels often develop surface carbides that cover 5 percent or more of their surface area when box annealed above the $A_1$ temperature. Further, it has been found that surface carbides cause poor adhesion of coatings, for example, zinc-iron (Zn-Fe) electrocoatings.

Some moderate success in minimizing surface carbide formation has been achieved by avoiding excessive times at high temperatures during the annealing process. This approach, however, has not proved to be commercially viable. Process control is difficult, productivity decreased, and manufacturing costs increased.

Phosphorus-containing coatings have been used for various purposes in steel-related applications. U.S. Pat. No. 3,308,042 discloses a process for producing electrolytic tin plate having superior corrosion resistance from steel strip treated with phosphate solutions prior to annealing. Phosphorous-containing solutions having pH between 2 and 7 and between 500 and 1500 ppm phosphate ion (0.05–0.2% phosphorous by weight) are disclosed. The treated strips are provided with surface films of phosphate ion of 0.15–0.35 mg $PO_4/ft^2$, equivalent to 0.05–0.11 mg $P/ft^2$. Essentially the same pre-anneal phosphate treatment is disclosed in U.S. Pat. No. 3,382,110, entitled Treatment of Ferrous Metal.

U.S. Pat. No. 2,501,846 discloses a process for producing silicon steel sheet stock having a high surface resistivity. In this process, silicon steel sheet or strip stock is passed through a phosphoric acid solution and then heat treated in a continuous furnace. This initial heat treatment may be followed by a box anneal, if desired. The process employs solutions ranging from 7.25% to 50% phosphoric acid by weight, equivalent to 73 to 646 grams $PO_4$ per liter of solution. The process provides, on average, a coating of 0.006 ounce $P/ft^2$, or 170 mg $P/ft^2$.

U.S. Pat. No. 2,748,037 discloses a method of treating stainless steels which are subsequently annealed, cooled in air, pickled to remove scale, and washed. The treatment consists of coating the steel with solutions which may contain, among other things. trisodium phosphate and phosphoric acid. The purpose of the treatment is to render foreign materials, e.g., dust and dirt, on the surface of the steel more readily removable during the pickling step, resulting in a smooth, uniform surface texture.

U.S. Pat. No. 3,104,993 discloses a process for galvanizing sheet metal on one side only. This is accomplished by providing on one side of the sheet metal a zinc barrier coating. The coating is applied as an aqueous colloidal solution of a refractory metal oxide and phosphoric or chromic acid, which is then heat treated before the sheet metal passes into the galvanizing bath.

SUMMARY OF THE INVENTION

The invention is a method for minimizing the formation of surface carbides during box annealing of drawing quality, specially-killed steels. The method comprises the steps of treating the surface of an aluminum-killed steel of a composition suitable for production of DQSK product with an aqueous solution containing from about 0.1 to about 1.0 moles of phosphate ion per liter to obtain a surface phosphorus concentration on the steel of at least about 10 mg $P/ft^2$, and annealing the steel in a hydrogen-containing atmosphere which is non-oxidizing to steel at a temperature of at least about 1250° F. and which may exceed the $A_1$ temperature. The product of the annealing is a drawing quality, specially-killed steel having a phosphorus-enriched layer at the surface. The formation of surface carbides is minimized in comparison with untreated steels.

The most notable advantage of the invention is that it minimizes the formation of surface carbides during box annealing of DQSK steels.

A second, related advantage is that by minimizing the formation of surface carbides the method of this invention improves the adherance of coatings to DQSK steels.

A third advantage is that the method of the invention may be employed without the loss in productivity and higher costs associated with the lowered tonnage per furnace hour when avoidance of temperatures above the $A_1$ temperature is required during box annealing.

DETAILED DESCRIPTION OF THE INVENTION

Aluminum-killed steels having a composition suitable for production of DQSK product are preferred for use in the method of the invention. Typical compositions of such steels, in weight percent, are:

C: 0.02 minimum, 0.08 maximum

Mn: 0.20 minimum, 0.40 maximum
P: 0.015 maximum
S: 0.020 maximum
Si: 0.03 maximum
Cu: 0.06 maximum
Ni: 0.04 maximum
Cr: 0.06 maximum
Mo: 0.03 maximum
Al: 0.02 minimum, 0.06 maximum
N: 0.003 minimum. 0.006 maximum
Fe: balance Both continuous cast and ingot cast steels are suitable for use in the invention. Typically the steel is in the form of as-cold-reduced strip or sheet stock. While it is preferred that the strip not have excessively high oil residues initially present, the method of the present invention has been found to be effective on uncleaned strip. Use of freshly cold-reduced strip or sheet is preferred.

In practicing the method of the invention, the surface of the aluminum-killed steel is treated with a phosphorus-containing aqueous solution prior to box annealing. The solution may be made up using a soluble phosphate compound. Preferred soluble phosphates for use in the aqueous solution include phosphoric acid ($H_3PO_4$), ammonium phosphate monobasic ($NH_4H_2PO_4$), and ammonium phosphate dibasic ($(NH_4)_2HPO_4$). Solutions of ammonium phosphate dibasic offer advantages in handling over acidic solutions in that solution pH values (about 7.5) are close to neutrality. Accordingly, use of ammonium phosphate dibasic is especially preferred. Soluble phosphates other than those mentioned as preferred, for example sodium phosphates and potassium phosphates, also may be used in the method of the invention. In preparing the solution, various soluble phosphates may be used alone or in combination, provided that the total phosphate ion concentration in solution is sufficient for purposes of the invention as described below.

The aqueous solution preferably contains from about 0.1 to about 1.0 moles of phosphate ion per liter. It has been found that use of solutions having concentrations within this range readily provides surface phosphorus concentrations within the preferred range described in more detail below. The following table illustrates the amounts of the preferred soluble phosphates necessary to prepare solutions suitable for use in the invention.

| Phosphate Ion Conc. | | $H_3PO_4$ | $(NH_4)_2HPO_4$ | $NH_4H_2PO_4$ |
|---|---|---|---|---|
| M(moles/liter) | g/l | g/l | g/l | g/l |
| 0.1 | 9.5 | 9.8 | 13.2 | 11.5 |
| 0.5 | 47.5 | 49.0 | 66.0 | 57.5 |
| 1.0 | 95.0 | 98.0 | 132.1 | 115.0 |

The method of applying the solution to the aluminum-killed steel is not a limitation. A spraying procedure, a dipping procedure, or any other suitable means may be employed.

As noted, the steel to be treated is typically in the form of as-cold-reduced sheet or strip stock. The phosphorus-containing solution is allowed to dry on the strip prior to heat treatment. If the solution is applied to freshly cold-reduced strip, which has typical temperatures of 200° to 250° F., the heat of the steel serves to dry the solution. Thus, use of freshly cold-reduced strip is preferred. Also, heated solutions may be employed to promote drying, a suitable solution temperature being 180° F.

The concentration of the solution and the amount of solution with which the steel is treated should be selected so as to obtain a surface phosphorus concentration on the steel of at least about 10 mg P/ft$^2$. It has been found that when surface phosphorus concentrations of 5 mg P/ft$^2$ or greater are introduced, the coverage of surface carbides on annealed DQSK steels is decreased. However, to consistently achieve desired low levels of carbide coverage (on the order of 1 percent or less), surface concentrations of 10 mg P/ft$^2$ or greater are required. It has also been found that while surface concentrations of phosphorus greater than 30 mg P/ft$^2$ may be employed, DQSK steels with treatment levels approaching 30 mg P/ft$^2$ have carbide coverages of 0.1 percent or less, far better than minimum requirements for commercial use. Therefore, a surface phosphorus concentration range of from about 10 to about 30 mg P/ft$^2$ is preferred.

After the aluminum-killed steel is treated with the phosphorus-containing solution and the solution is allowed to dry, the steel is box annealed to impart desired formability characteristics. The temperature during box annealing should be at least about 1250° F. and may exceed the $A_1$ temperature, which is about 1340° to 1350° F. for low carbon steels. To obtain suitable sheet surface finishes, the atmosphere during the box annealing should be non-oxidizing to steel. Conventional reducing-type atmospheres such as hydrogen or mixtures of hydrogen with nitrogen or argon are preferably employed.

The product of the annealing is a drawing quality, specially-killed steel having a phosphorus-enriched layer at the surface. The formation of surface carbides is minimized in comparison with untreated steels. By cross-sectioning DQSK steel specimens treated and annealed according to the invention it has been learned that a carbide-depleted zone at the surface is enriched with phosphorus, the depth of such a zone in many cases being substantial. For example, one steel treated before box annealing with a 0.5 molar (49 grams/liter) solution of phosphoric acid had a carbide-depleted zone about 2 mils in depth with an average phosphorus concentration in the zone of about 0.05 percent. The initial phosphorus concentration in this steel was 0.008 percent. The carbon content in the zone was also lowered.

One possible mechanism to explain the effectiveness of the pre-anneal phosphate treatment of the invention involves reduction by hydrogen in the box annealing atmosphere of an iron phosphate layer that forms on the steel surface either before or during annealing, followed by diffusion of phosphorus into the steel. It is not known whether phosphorus so introduced tends to raise the $A_1$ temperature above normal levels or if the role of phosphorus is to modify carbon diffusivity. Of course, the inventor does not intend that the scope of the invention be limited by any theory of the mechanism by which it works.

To assess the effectiveness of the method of the invention, it may be desired, to examine microscopically the surfaces of DQSK steels treated and annealed according to the invention. If such an examination is to be made, the steel samples should be etched prior to examination to facilitate identification of carbides. If a scanning electron microscope (SEM) is to be used, the steel samples may be etched for 30 seconds at room temperature with a solution made up by adding 5 drops reagent grade hydrochloric acid per 100 ml of a solution containing 10% picric acid and 90% methanol (anhydrous grade containing 5% water). If an optical microscope is to be used the steel samples may be etched with a solution of 2 to 4% by volume reagent grade nitric acid in methanol (anhydrous grade containing 5% water). A solution of 10% by weight ammonium persulfate in water may also be used. Etching times from 0.5 to 2 minutes may be employed. Microscopic examination of etched samples allows estimation of carbide coverage in terms of percent area, and, in some instances, estimation of carbide sizes.

The following examples are intended to further illustrate the invention without limiting its scope.

EXAMPLE 1

Test panels 4 ×6 inches in size were cut from a 0.033-inch-thick as-cold-reduced aluminum-killed continuous-cast steel of a composition suitable for production of DQSK product (0.042% C., 0.30% Mn, 0.006% P, 0.009% S, 0.011% Si, 0.029% Cu, 0.021% Ni, 0.023% Cr, 0.008% Mo, 0.046% Al, 0.005% N). Before annealing, one group of panels was subjected to a dip treatment at 180° F. in an aqueous solution made up with 34 ml of 85phosphoric acid per liter (49 grams $H_3P_4$/l of solution or 0.5 moles/l). After treatment the surface concentration of phosphorus was 18 mg/ft$^2$. Another group of panels, for comparison, was not treated.

All panels were annealed in a stack in a weld-sealed stainless steel box heated in a muffle furnace to simulate a commercial box annealing cycle. The box had gas entry and exit tubes used to pass a reducing protective atmosphere containing hydrogen (6% hydrogen - 94% argon) over the stack of panels during annealing. The panels were heated to temperatures above the $A_1$ temperature, held for 6 hours in the range 1364° F. to 1375° F. and then cooled to room temperature. The box was cut open and annealed panels were subjected to metallographic examination.

Examination of untreated annealed panels by appropriate etching of cross sections and by scanning electron microscopy (SEM) revealed the presence of carbides on both surfaces with from 5 to 6% coverage of the surface. Treated annealed panels, however, were found to have less than 0.1% coverage of the surface by carbides; a carbide-depleted zone about 0.002 inch in depth was present at both surfaces.

EXAMPLE 2

Test panels 3 ×8 inches in size were cut from a 0.0520-inch thick as-cold-reduced aluminum-killed ingot-cast steel of a composition suitable for production of DQSK product (0.051% C, 0.29% Mn, 0.012% P, 0.010% S, 0.015% Si, 0.012% Cu, 0.012% Ni, 0.022% Cu, <0.005% Mo, 0.042% Al, 0.004% N). Before annealing, one group of panels was subjected to a dip treatment at 180° F. in an aqueous solution that contained 39 grams ammonium phosphate dibasic [$(NH_4)_2HP_4$] per liter or 0.3 moles/l. After treatment the surface concentration of phosphorus was 9.7 mg/ft$^2$. Another group of panels, for comparison, was not treated.

All panels were annealed as described in Example 1 except that these panels were held for 8 hours in the range 1350° F. to 1380° F.

Examination of untreated annealed panels revealed that surface carbides were present on both surfaces with 6% coverage on one surface and 8% coverage on the opposite surface. Treated annealed panels had surface carbides but with only 1% coverage on both surfaces; a carbide-depleted zone about 0.0015 inch in depth was present at both surfaces.

EXAMPLE 3

Test panels 3 ×8 inches in size were cut from a 0.0317-inch thick as-cold-reduced aluminum-killed continuous-cast steel of a composition suitable for production of DQSK product (0.048% C, 0.31% Mn, 0.004% P, 0.016% S. 0.027% Si, 0.011% Cu, 0.010% Ni, 0.017% Cr, 0.011% Mo, 0.053% Al, 0.007% N). Before annealing, one group of panels was subjected to a dip treatment at 180° F. in an aqueous solution that contained 66 grams ammonium phosphate monobasic [$NH_4H_2PO_4$]per liter or 0.5 moles/l. After treatment, the surface concentration of phosphorus was 23 mg/ft$^2$. Another group of panels, for comparison, was not treated.

All panels were annealed in a similar manner to those described in the above examples except that these panels were held for 6.5 hours in the range 1340° F. to 1380° F.

Examination of untreated annealed panels revealed that surface carbides were present on both surfaces with 3.5% coverage on one surface and 2.5% coverage on the opposite surface. Treated annealed panels had surface carbides with less than 0.1% coverage on both surfaces: a carbide-depleted zone of from 0.002 to 0.003 inch in depth was present at both surfaces.

While the invention has been described in detail and with reference to examples, it is not intended to be limited to specifics of the description. Variations from the description which remain within the spirit and scope of the invention as defined in the following claims may appear to those skilled in the art.

What is claimed is:

1. A method for minimizing surface carbide formation during box annealing of DQSK steels comprising:

(a) treating the surface of an aluminum-killed steel of a composition suitable for production of DQSK product with an aqueous solution containing from about 0.1 to 1.0 moles of phosphate ion per liter to provide a surface phosphorus concentration on the steel of at least about 10 mg P/ft$^2$; and (b) subjecting the treated steel to box annealing at a temperature of at least about 1250° F. and in a hydrogen-containing atmosphere which is non-oxidizing to steel.

2. The method of claim 1, whereby a phosphorus-enriched layer is formed at the surface of the DQSK steel and the coverage of surface carbides on the surface of the DQSK steel is reduced to 1% or less of the total surface area.

3. The method of claim 1, wherein the aluminum-killed steel of a composition suitable for production of DQSK product has a composition, in weight percent, as follows:

C: 0.02 minimum, 0.08 maximum
Mn: 0.20 minimum, 0.40 maximum
P: 0.015 maximum
S: 0.020 maximum
Si: 0.03 maximum
Cu: 0.06 maximum
Ni: 0.04 maximum
Cr: 0.06 maximum
Mo: 0.03 maximum
Al: 0.02 minimum, 0.06 maximum N 0.003 minimum, 0.006 maximum Fe: balance.

4. The method of claim 1, wherein the aqueous solution comprises a soluble phosphate selected from the group consisting of phosphoric acid, ammonium phosphate monobasic, ammonium phosphate dibasic, and combinations thereof.

5. The method of claim 1, wherein the aqueous solution comprises ammonium phosphate dibasic.

6. The method of claim 1, wherein the surface phosphorous concentration on the steel is within the range of from about 10 to 30 mg $P/ft^2$.

7. The method of claim 1, wherein the temperature during box annealing exceed the $A_1$ temperature of the steel.

8. The method of claim 1, wherein the box annealing atmosphere is selected from the group consisting of hydrogen, mixtures of hydrogen with nitrogen, and mixtures of hydrogen with argon.

* * * * *